US005865196A

United States Patent [19]

Foote

[11] Patent Number: 5,865,196

[45] Date of Patent: Feb. 2, 1999

[54] HAIR STYLIST FACE SHIELD

[76] Inventor: Mary L. Foote, 2001 83 Ave. North #1271, St. Petersburg, Fla. 33702

[21] Appl. No.: 67,987

[22] Filed: Apr. 29, 1998

[51] Int. Cl.[6] ..... A45D 40/30; A45D 29/00; A41D 13/00; A42B 1/18

[52] U.S. Cl. ..... 132/314; 132/285; 2/9; 2/174

[58] Field of Search ..... 132/319, 212, 132/285; 2/9, 174, 206, 434

[56] References Cited

U.S. PATENT DOCUMENTS

| | | | |
|---|---|---|---|
| 3,602,913 | 9/1971 | Neese | 2/9 |
| 3,695,265 | 10/1972 | Brevik | 128/146.2 |
| 4,396,027 | 8/1983 | Loewenstine | 2/9 |
| 5,135,013 | 8/1992 | DePaolo | 132/319 |
| 5,311,888 | 5/1994 | Leigh | 132/319 |
| 5,503,167 | 4/1996 | Wilson et al. | 132/319 |
| 5,538,014 | 7/1996 | Wilson et al. | 128/863 |
| 5,642,528 | 7/1997 | Dering | 2/174 |

FOREIGN PATENT DOCUMENTS

| | | | |
|---|---|---|---|
| 2100980 | 1/1983 | United Kingdom | 132/319 |

*Primary Examiner*—John J. Wilson
*Assistant Examiner*—Trang Doan
*Attorney, Agent, or Firm*—Joseph N. Breaux

[57] ABSTRACT

A hair stylist face shield for shielding the face are of a client receiving hair styling services. The hair stylist face shield includes a face screening member, a rigid, elongated handle, an air filter element and two stacks of transparent, peel-off, eye opening cover members. The molded plastic face shield member is molded to form a face receiving cavity contoured to receive therein the chin, nose, eye, forehead and cheek areas of a user and includes a mouth/nose area opening and two eye openings. The handle is rigidly connected to the inner surface wall of the chin area of the face member and extending downwardly away from the chin covering area of the face screening member. The air filter element is adhesively secured to the interior of the face screening member and covers the mouth/nose area opening such that all air drawn through the mouth/nose area opening must be drawn through the air filter element. Each of the two stacks of transparent, peel-off, eye opening cover members is positioned over one of the two eye openings formed through the face shield member. Each of the peel-off, eye opening cover members includes a transparent center portion, a restickable adhesive covered perimeter edge encircling the transparent center portion, and gripping tab extending outwardly from the perimeter edge. Each of the two stacks of transparent, peel-off, eye opening cover members is configured such that the gripping tabs are arranged in a staggered relationship.

8 Claims, 2 Drawing Sheets

HAIR STYLIST FACE SHIELD

TECHNICAL FIELD

The present invention relates to shields and the like and more particularly to a hair stylist face shield for shielding the face of a hair styling customer from styling sprays that includes a molded plastic face screening member, a rigid, elongated handle, an air filter element and two stacks of transparent, peel-off, eye opening cover members; the molded plastic face shield member being molded to form a face receiving cavity contoured to receive therein the chin, nose, eye, forehead and cheek areas of a user and including a mouth/nose area opening and two eye openings; the handle being rigidly connected to the inner surface wall of the chin area of the face member and extending downwardly away from the chin covering area of the face screening member; the air filter element being secured to the interior of the face screening member and covering the mouth/nose area opening such that all air drawn through the mouth/nose area opening must be drawn through the air filter element; each of the two stacks of transparent, peel-off, eye opening cover members being positioned over one of the two eye openings formed through the face shield member and including multiple transparent, peel-off, eye opening cover members; each of the peel-off, eye opening cover members including a transparent center portion, a restickable adhesive covered perimeter edge encircling the transparent center portion, and gripping tab extending outwardly from the perimeter edge; each of the two stacks of transparent, peel-off, eye opening cover members being configured such that the gripping tabs are arranged in a staggered relationship.

BACKGROUND ART

It is often necessary when styling hair to spray hair styling liquids and the like onto sections of the client's hair. This spraying can result in unwanted covering of the client's face and eyes with undesirable hair styling solutions and the unhealthy breathing of fumes generated by the spraying. It would be a benefit, therefore, to have a face shield that could be used to shield the face area of a person receiving hair styling services from undesirable styling liquid overspray. It would be a further benefit to have a face shield that also included a filter element through which the styling client could breath while the face shield was in place. Because the viewing openings of the face shield can become hard to see through when covered with hair styling spray, it would be a further benefit to have a face shield that included peel-off eye opening covers that could be removed when covered with hair styling spray to allow the costumer to see clearly through the eye openings in order to view the stylist at work on the hair.

GENERAL SUMMARY DISCUSSION OF INVENTION

It is thus an object of the invention to provide a hair stylist face shield for shielding the face area of a client receiving hair styling services.

It is a further object of the invention to provide a hair stylist face shield that includes an air filter element through which the styling client breathes while the face shield is in place.

It is a still further object of the invention to provide a hair stylist face shield that includes peel-off eye opening covers that are removed when covered with hair styling spray to allow the customer to see clearly through the eye openings in order to view the stylist at work on the hair.

It is a still further object of the invention to provide a hair stylist face shield that includes a molded plastic face screening member, a rigid, elongated handle, an air filter element and two stacks of transparent, peel-off, eye opening cover members; the molded plastic face shield member being molded to form a face receiving cavity contoured to receive therein the chin, nose, eye, forehead and cheek areas of a user and including a mouth/nose area opening and two eye openings; the handle being rigidly connected to the inner surface wall of the chin area of the face member and extending downwardly away from the chin covering area of the face screening member; the air filter element being secured to the interior of the face screening member and covering the mouth/nose area opening such that all air drawn through the mouth/nose area opening must be drawn through the air filter element; each of the two stacks of transparent, peel-off, eye opening cover members being positioned over one of the two eye openings Formed through the face shield member and including multiple transparent, peel-off, eye opening cover members; each of the peel-off, eye opening cover members including a transparent center portion, a restickable adhesive covered perimeter edge encircling the transparent center portion, and gripping tab extending outwardly from the perimeter edge; each of the two stacks of transparent, peel-off, eye opening cover members being configured such that the gripping tabs are arranged in a staggered relationship.

It is a still further object of the invention to provide a hair stylist face shield that accomplishes some or all of the above objects in combination.

Accordingly, a hair stylist face shield is provided. The hair stylist face shield includes a molded plastic face screening member, a rigid, elongated handle, an air filter element and two stacks of transparent, peel-off, eye opening cover members; the molded plastic face shield member being molded to form a face receiving cavity contoured to receive therein the chin, nose, eye, forehead and cheek areas of a user and including a mouth/nose area opening and two eye openings; the handle being rigidly connected to the inner surface wall of the chin area of the face member and extending downwardly away from the chin covering area of the face screening member; the air filter element being secured to the interior of the face screening member and covering the mouth/nose area opening such that all air drawn through the mouth/nose area opening must be drawn through the air filter element; each of the two stacks of transparent, peel-off, eye opening cover members being positioned over one of the two eye openings formed through the face shield member and including multiple transparent, peel-off, eye opening cover members; each of the peel-off, eye opening cover members including a transparent center portion, a restickable adhesive covered perimeter edge encircling the transparent center portion, and gripping tab extending outwardly from the perimeter edge; each of the two stacks of transparent, peel-off, eye opening cover members being configured such that the gripping Labs are arranged in a staggered relationship.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
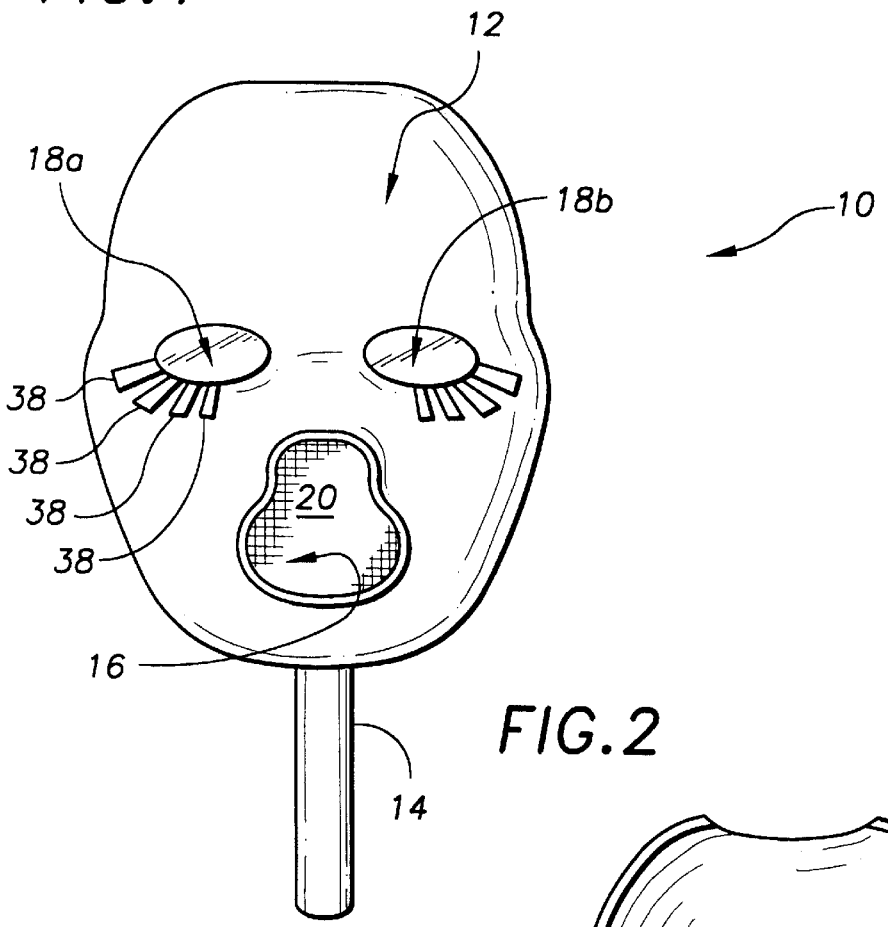
FIG. 1 is a front plan view of an exemplary embodiment of the hair stylist face shield of the present invention showing the molded plastic face screening member that is contoured to fit over the face of a hair styling customer and that includes the mouth/nose area opening and the two eye openings; the handle rigidly connected to and extending downwardly from the chin covering area of the face screening member; the air filter element secured to the interior of the face screening member and covering the mouth/nose area opening; and the two stacks of transparent, peel-off, eye opening cover members each with a staggered gripping tab.

FIG. 1 shows an exemplary embodiment of the hair stylist face shield of the present invention, generally designated by the numeral 10. Face shield 10 includes a molded plastic face screening member, generally designated 12; a rigid, elongated, handle 14; a pressed paper, air filter element, generally designated 16; and two stacks of transparent, peel-off, eye opening cover members, generally designated 18*a*, 18*b*.

Figure 2:
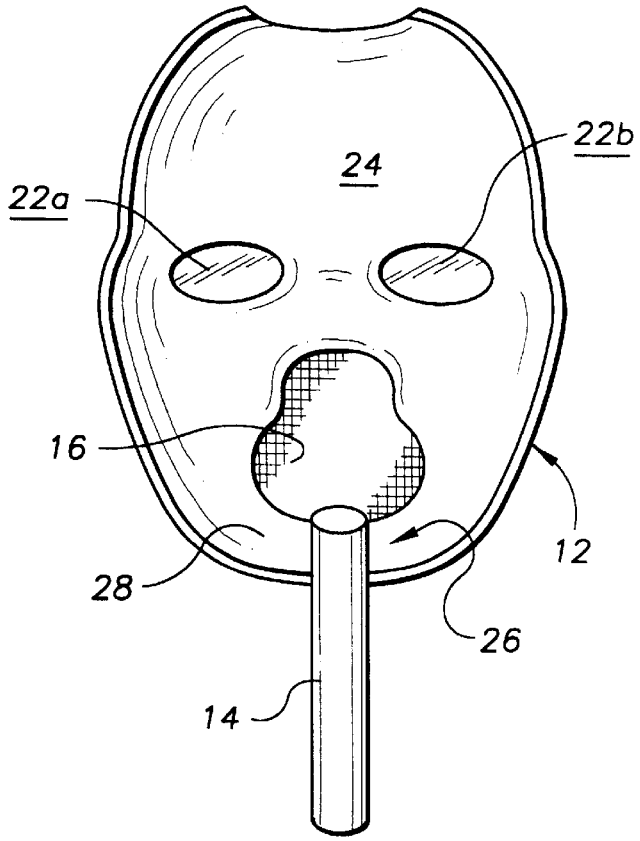
FIG. 2 is a back side plan view of the exemplary hair stylist face shield of FIG. 1 showing the face receiving cavity of the molded plastic face screening member; the handle rigidly connected to the inner surface wall of the chin area of the face screening member; the air filter element secured to the interior of the face screening member and covering the mouth/nose area opening; and the two stacks of transparent, peel-off, eye opening cover members each with a staggered gripping tab.

Face screening member 12 is of molded plastic construction and includes a mouth/nose area opening 20 and, with reference now to FIG. 2, two eye openings 22*a*, 22*b*. Screening member 12 has a receiving cavity 24 molded into the back side thereof within which a chin receiving cavity portion, generally designated 26, is provided. In this embodiment, handle 14 is an elongated plastic member having a hanging aperture 15 and is rigidly connected to the inner surface wall 28 of chin receiving portion 26.

Figure 3:
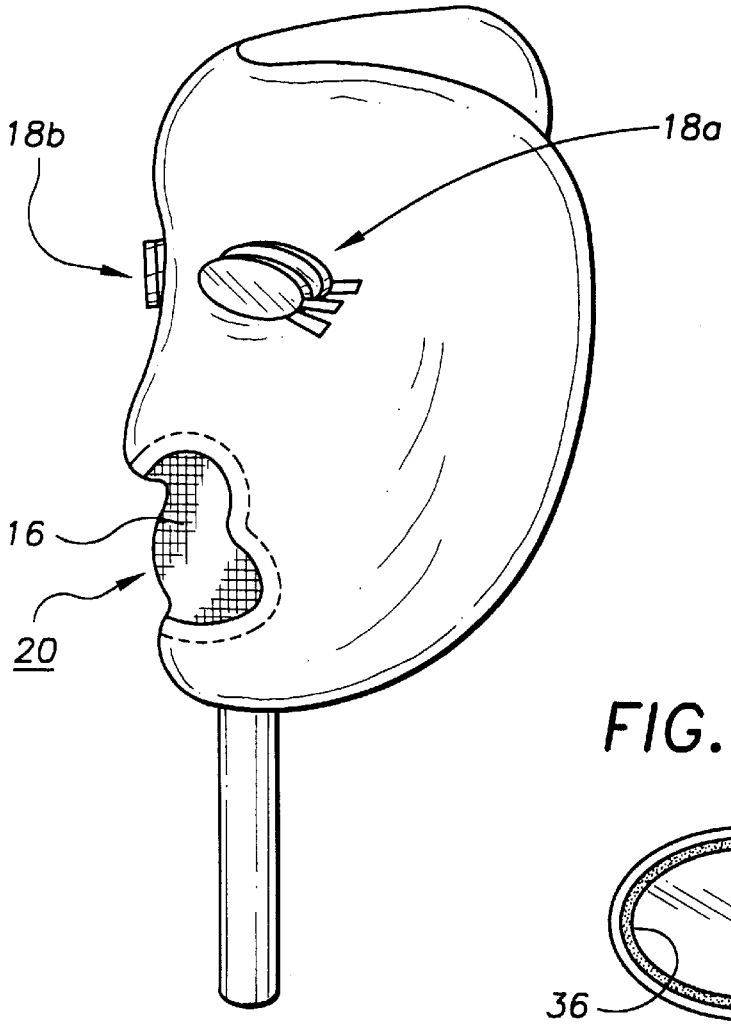
FIG. 3 is a side perspective view of the exemplary hair stylist face shield of FIG. 1 showing the molded plastic face screening member; the air filter element; and the two stacks of transparent, peel-off, eye opening cover members.

Pressed paper air filter 16 is adhesively secured to inner surface wall 28 and over, with reference to FIG. 3, mouth/nose opening 20 such that all air drawn through mouth/nose area opening 20 must be drawn through air filter element 16.

Figure 4:
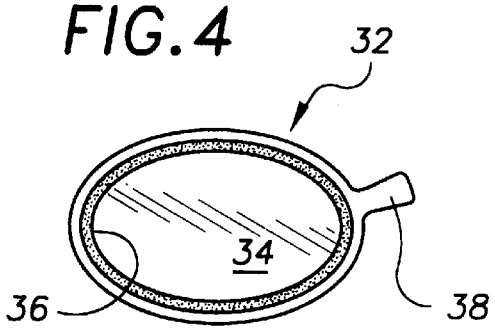
FIG. 4 is a plan view of one of the peel-off, eye opening cover members in isolation showing the transparent center portion, the restickable adhesive covered perimeter edge encircling the transparent center portion, and the gripping tab extending outwardly from the perimeter edge.
Figure 5:
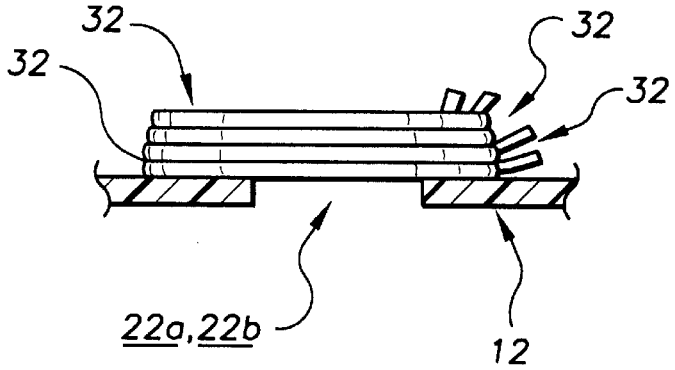
FIG. 5 is a side cross sectional view showing one of the two stacks of transparent, peel-off, eye opening cover members positioned over one of the two eye openings of -the molded plastic face screening member.

The two stacks of transparent, peel-off, eye opening cover members 18*a*, 18*b* are, with reference now to FIG. 4, composed of multiple peel-off, transparent plastic film, eye opening cover members 32 that each includes a transparent center portion 34, a perimeter edge 36 encircling transparent center portion 34 upon which a layer of the restickable adhesive is deposited, and a rectangular gripping tab 38 extending outwardly from perimeter edge 36. With reference to FIG. 5, during assembly, four eye opening cover members 32 are stacked one atop the other over an eye opening 22*a*, 22*b* of face screening member 12. With reference back to FIG. 1, each of the stacks of transparent, peel-off, eye opening cover members 18*a*, 18*b* are configured such that the gripping tabs 38 are arranged in a staggered relationship.

It can be seen from the preceding description that a hair stylist face shield for shielding the face are of a client receiving hair styling services has been provided that includes an air filter element through which the styling client breathes while the face shield is an place; that includes peel-off eye opening covers that are removed when covered with hair styling spray to allow the costumer to see clearly through the eye openings in order to view the stylist at work on the hair; and that includes a molded plastic face screening member, a rigid, elongated handle, an air filter element and two stacks of transparent, peel-off, eye opening cover members; the molded plastic face shield member being molded to form a face receiving cavity contoured to receive therein the chin, nose, eye, forehead and cheek areas of a user and including a mouth/nose area opening and two eye openings; the handle being rigidly connected to the inner surface wall of the chin area of the face member and extending downwardly away from the chin covering area of the face screening member; the air filter element being secured to the interior of the face screening member and covering the mouth/nose area opening such that all air drawn through the mouth/nose area opening must be drawn through the air filter element; each of the two stacks of transparent, peel-off, eye opening cover members being positioned over one of the two eye openings formed through the face shield member and including multiple transparent, peel-off, eye opening cover members; each of the peel-off, eye opening cover members including a transparent center portion, a restickable adhesive covered perimeter edge encircling the transparent center portion, and gripping tab extending outwardly from the perimeter edge; each of the two stacks of transparent, peel-off, eye opening cover members being configured such that the gripping tabs are arranged in a staggered relationship.

It is noted that the embodiment of the hair stylist face shield described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be Interpreted as illustrative and not in a limiting sense.

What is claimed is:

1. A hair stylist face shield comprising:

a molded face screening member;

a rigid handle secured to said face screening member;

an air filter element; and two stacks of transparent, peel-off, eye opening cover member;

said molded face shield member being molded to form a face receiving cavity contoured to receive therein the chin, nose, eye, forehead and cheek areas of a user and including a mouth/nose area opening and two eye openings;

said air filter element being secured to an interior surface of said face screening member and covering said mouth/nose area opening such that all air drawn through said mouth/nose area opening must be drawn through said air filter element;

each of said two stacks of transparent, peel-off, eye opening cover members being positioned over one of said two eye openings formed through said face shield member and including multiple transparent, peel-off, eye opening cover members;

each of said peel-off, eye opening cover members including a transparent center portion, a restickable adhesive covered perimeter edge encircling said transparent center portion, and a gripping tab extending outwardly from said perimeter edge.

2. The hair stylist face shield of claim 1, wherein:

said molded face screening member is molded of plastic.

3. The hair stylist face shield of claim 1 wherein:

each of said two stacks of transparent, peel-off, eye opening cover members is configured such that said gripping tabs are arranged in a staggered relationship.

4. The hair stylist face shield of claim 1, wherein:

said handle is rigidly connected to an inner surface wall of said chin covering area of said face screening member and extends downwardly away from said chin covering area of said face screening member.

5. The hair stylist face shield of claim 2 wherein:

each of said two s tacks of transparent, peel-off, eye opening cover members is configured such that said gripping tabs are arranged in a staggered relationship.

6. The hair stylist face shield of claim 2, wherein:

said handle Is rigidly connected to an inner surface wall of said chin covering area of said face screening member and extends downwardly away from said chin covering area of said face screening member.

7. The hair stylist face shield of claim 5, wherein:

said handle is rigidly connected to an inner surface wall of said chin covering area of said face screening member and extends downwardly away from said chin covering area of said face screening member.

8. The hair stylist face shield of claim 3, wherein:

said handle is rigidly connected to an inner surface wall of said chin covering area of said face screening member and extends downwardly away from said chin covering area of said face screening member.

* * * * *